US006094040A

United States Patent [19]

Meier et al.

[11] Patent Number: 6,094,040

[45] Date of Patent: Jul. 25, 2000

[54] VOLTAGE REGULATOR CIRCUIT

[75] Inventors: Jürgen Meier; Hans-Jörg Florenz, both of Maulburg; Armin Wernet, Rheinfelden, all of Germany

[73] Assignee: Endress + Hauser GmbH + Co., Maulburg, Germany

[21] Appl. No.: 09/262,434

[22] Filed: Mar. 4, 1999

[30] Foreign Application Priority Data

Mar. 20, 1998 [DE] Germany ..... 98105108

[51] Int. Cl.[7] ..... G05F 1/56

[52] U.S. Cl. ..... 323/284; 323/282

[58] Field of Search ..... 323/273, 274, 323/282, 284; 363/84, 89, 125, 127

[56] References Cited

U.S. PATENT DOCUMENTS

| | | | |
|---|---|---|---|
| 4,642,746 | 2/1987 | Losel | 363/49 |
| 4,754,388 | 6/1988 | Pospisil . | |
| 4,893,228 | 1/1990 | Orrick et al. . | |
| 4,967,138 | 10/1990 | Obergfell et al. | 363/224 |
| 5,191,278 | 3/1993 | Carpenter . | |
| 5,686,821 | 11/1997 | Brokaw . | |
| 5,754,388 | 5/1998 | Schmidt . | |
| 5,773,965 | 6/1998 | Hayashi | 323/222 |
| 5,889,390 | 3/1999 | Preis et al. | 323/222 |

FOREIGN PATENT DOCUMENTS 0 811 901 12/1997 European Pat. Off. .

OTHER PUBLICATIONS

"Sender and Receiver for Optical VF–Transmission", Radio Fernsehen Elektronik, Bd. 45, Nr. 12, Dec., 1996, pp. 70–71, in German Language with English Language Translation.

"Sender und Emplänger für die optische NF–Übertragung", Radio Fernsehen Elektronik, Bd. 45, No. 12, Dec., 1996.

*Primary Examiner*—Matthew Nguyen

*Attorney, Agent, or Firm*—Bose McKinney & Evans LLP

[57] ABSTRACT

A voltage regulator circuit for generating a regulated output DC voltage from a non-regulated DC or AC voltage, comprises an input rectifier circuit for rectifying the non-regulated AC voltage and a series regulator, containing a gate-controllable transistor, which regulates the output voltage supplied to it by the rectifier to a first voltage value. The transistor of the series regulator is a field-effect transistor (20) which in the ON condition charges a charging capacitor (46), the charging voltage of which forms the regulated output voltage. Connected to the gate terminal (21) of the field-effect transistor is a first threshold circuit (26, 28, 30, 32) receiving the non-regulated DC voltage which applies to this gate terminal (21) a voltage turning OFF the field-effect transistor (20) as soon as the non-regulated DC voltage exceeds a predetermined threshold value. Furthermore, connected to the gate terminal (21) of the field-effect transistor (20) is a second threshold circuit (36, 38, 40, 42) receiving the regulated output DC voltage which applies to this gate terminal (21) a voltage turning OFF the field-effect transistor (20) as soon as the regulated output DC voltage exceeds a predetermined design value.

4 Claims, 2 Drawing Sheets

VOLTAGE REGULATOR CIRCUIT

FIELD OF THE INVENTION

The invention relates to a voltage regulator circuit for generating a regulated output DC voltage from a non-regulated DC or AC voltage, comprising an input rectifier circuit for rectifying the non-regulated AC voltage and a series regulator, containing a gate-controllable transistor, which regulates the output voltage supplied to it by the rectifier to a first voltage value.

BACKGROUND OF THE INVENTION

Known from U.S. Pat. No. 4,754,388 is one such voltage regulator circuit. This voltage regulator circuit contains in the series branch ahead of the actual series regulator a transistor circuit which acts as a switch and interrupts the current flowing to the series regulator as soon as the input voltage exceeds a predetermined value. Interrupting the current may result in high current and voltage peaks in the circuit, requiring the circuit to include components capable of withstanding these high current and voltage peaks.

SUMMARY OF THE INVENTION

The invention is based on the object of providing a voltage regulator circuit of the aforementioned kind in which there is no need to subject the components, especially those as used at the output, to any high requirements as regards current and voltage compatability.

To achieve this object the voltage regulator circuit in accordance with the invention is characterized in that the transistor of the series regulator is a field-effect transistor which in the ON condition charges a charging capacitor, the charging voltage of which forms the regulated output voltage, in that connected to the gate terminal of the field-effect transistor is a first threshold circuit receiving the non-regulated DC voltage which applies to this gate terminal a voltage turning OFF the field-effect transistor as soon as the non-regulated DC voltage exceeds a predetermined threshold value, and in that connected to the gate terminal of the field-effect transistor is a second threshold circuit receiving the regulated output DC voltage which applies to this gate terminal a voltage turning OFF the field-effect transistor as soon as the regulated output DC voltage exceeds a predetermined design value.

In the voltage regulator circuit in accordance with the invention the field-effect transistor of the series regulator is controlled by a voltage applied to its gate terminal to achieve the desired regulating function, resulting in the hard switching actions of the current flowing through the transistor being avoided, the field-effect transistor instead behaving like a steerable impedance element which with the aid of the control voltages from the threshold circuits may be switched between the low-impedance condition and the high impedance condition so that steep switching edges and thus high current and voltage peaks are avoided.

Advantageous further aspects of the invention are characterized in the sub-claims.

BRIEF DESCRIPTION OF THE DRAWINGS

The invention will now be explained by way of an example with respect to the drawing in which.

DESCRIPTION OF THE PREFERRED EMBODIMENTS

Figure 1:
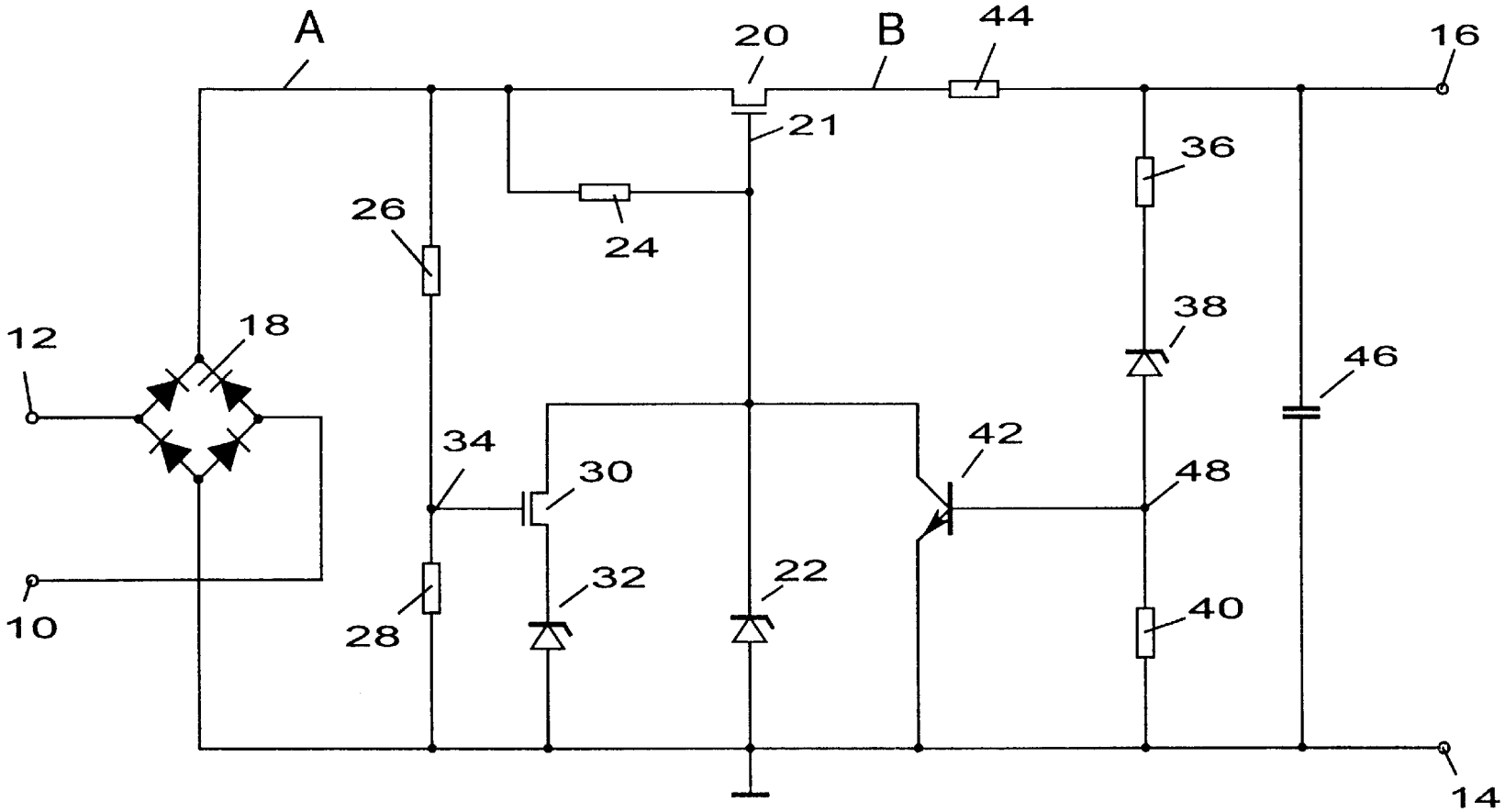
FIG. 1 is a single-line diagram of the voltage regulator circuit in accordance with the invention and FIGS. 2*a* and 2*b* are time plots of the voltage and current at point A and point B respectively.

Referring now to FIG. 1 there is illustrated the voltage regulator circuit serving to generate at the output terminals 14, 16 a regulated DC voltage from an input voltage applied between the input terminals 10, 12, whereby the input voltage may be a DC voltage or also an AC voltage. The circuit is intended for the input voltage to be a DC voltage between 20V and 55V or an AC voltage between 20V and 253V, the constant output DC voltage being intended to be 11V. Should the input voltage be an AC voltage it is first rectified by a bridge rectifier 18.

The core of the regulator circuit is a conventional series regulator comprising a transistor 20, in this case a field-effect transistor, a Zener diode 22 and a resistor 24. Such a series regulator is known to produce at its output a constant DC output voltage corresponding to the Zener voltage of the Zener diode 22 except for the drop in voltage across the transistor 20, whereby the input voltage of this series regulator must always be larger than the desired regulated DC output voltage, of course.

Since the circuit as shown in FIG. 1 is to receive a AC input voltage of up to 253 V, some means of limiting the dissipation loss occurring in the circuit needs to be provided. Limiting the current by the transistor 20 occurs as soon as the regulating action of the series regulator is active, the main component of the series regulator being the transistor 20. Onset of series regulation commences as soon as the output voltage of the rectifier 18 exceeds the Zener voltage of the Zener diode 22. However, since the voltage at the output of the rectifier 18 continues to increase, the dissipation loss in the field-effect transistor 20 would likewise increase were this not prevented by a first threshold circuit which, as detailled below, interrupts the current flowing through the field-effect transistor 20 as soon as a predetermined value of the output voltage of the rectifier 18 is attained. Due to the current through the transistor 20 being interrupted the undesirable increase in the dissipation loss in this transistor may be effectively prevented. The first threshold circuit consists of a voltage divider with the resistors 26 and 28, a field-effect transistor 30 and a Zener diode 32. The gate terminal 21 of the field-effect transistor 30 is connected to the connecting point 34 of the two resistors 26 and 28, its drain terminal being connected to the gate terminal 21 of the field-effect transistor 20 and its source terminal is connected to the cathode of the Zener diode 32, the anode of which is grounded.

In the circuit as shown in FIG. 1 a further threshold switch is contained, consisting of the series connection of a resistor 36, a Zener diode 38 and a further resistor 40 as well as an NPN transistor 42. The series connection of the resistor 36, the Zener diode 38 and the resistor 40 is connected between the output terminal 16 and ground. The collector of the transistor 42 is connected to the gate terminal 21 of the field-effect transistor 20, whilst its emitter is grounded. The base of the transistor 42 is connected to the connecting point between the anode of the Zener diode 38 and the resistor 40. Circuited between the transistor 20 and the output terminal 16 is a further resistor 44. Furthermore, a charging capacitor 46 is connected between the output terminals 14 and 16.

Figures 2A, 2B:
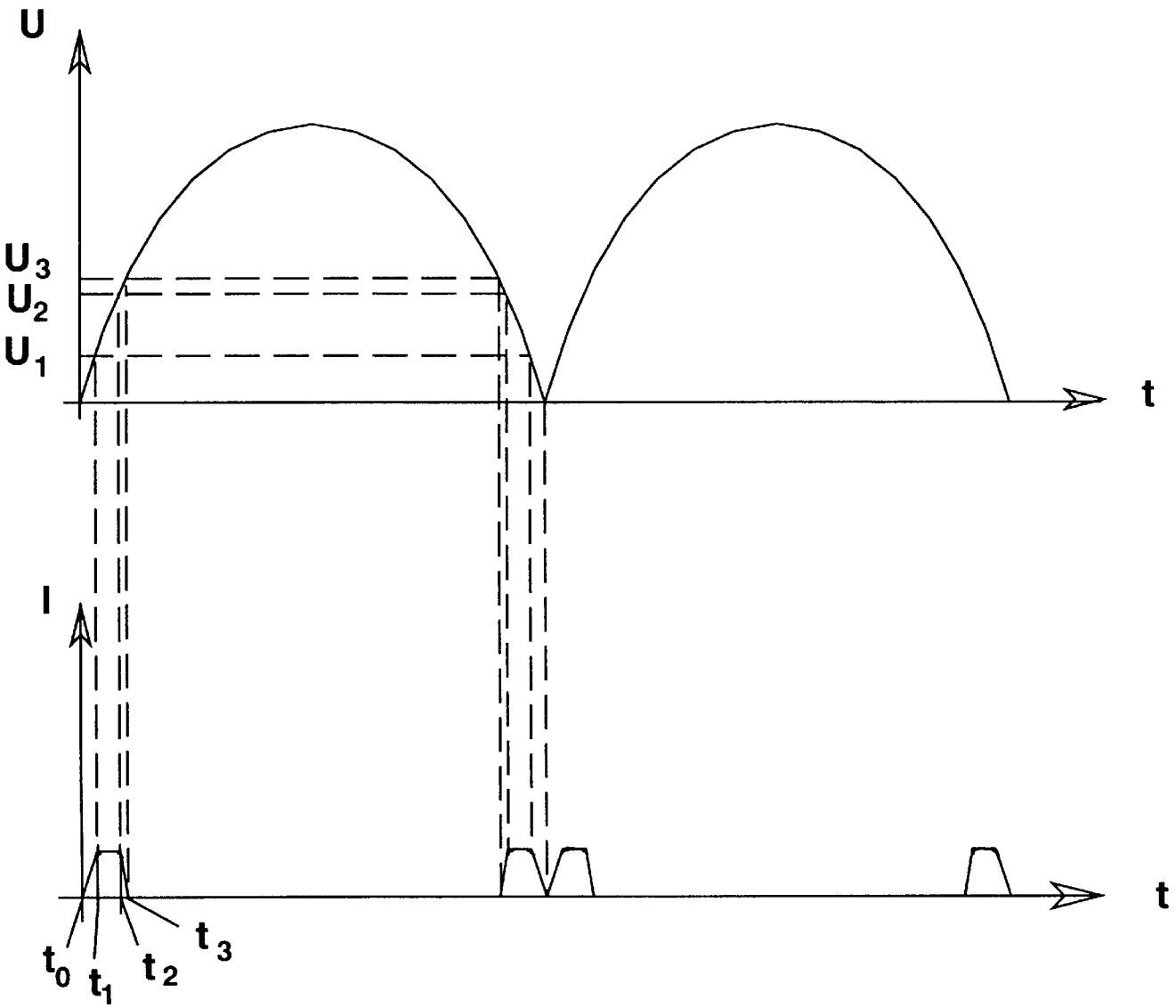

Assuming now that the line voltage of 220 V is applied to the voltage regulator circuit as shown in FIG. 1, then this voltage is rectified in the bridge rectifier 18 so that a rectified voltage having the profile as evident from FIG. 2*a* appears between the ground conductor and the conductor identified A. At the point in time $t_0$ as indicated in FIG. 2*a* a current commences to flow on increase of the voltage through the transistor 20, i.e. the current likewise increasing with the increase in voltage. As soon as the voltage attains a value which is larger than the value of the Zener voltage of the Zener diode 22, the regulating action of the series regulator is activated so that the voltage at the point B is limited to this voltage value. At the same time the regulating action also causes the current flowing through the transistor 20 to be limited. To prevent the dissipation loss at the transistor 20 from further increasing with the further increase in the output voltage of the rectifier 18 the action of the aforementioned first threshold switch commences once a predetermined value of the rectified AC voltage is attained. As soon as the voltage at the pick-off point 34 of the voltage divider formed by the resistors 26 and 28 attains a predetermined voltage value the field-effect transistor 30 is turned ON so that the voltage at gate terminal 21 of the transistor 20 is diminished until this transistor translates into the OFF condition. It has already been mentioned above that the circuit need to be designed so that it also outputs the desired regulated DC voltage of 11V at the output even when the input DC voltages are as high as 55V. It is for this reason that the first threshold switch must not, of course, prompt the transistor 20 to translate into the OFF condition until the output voltage of the rectifier 18 exceeds the voltage value 55V, since any earlier prompting by the first threshold switch would reduce the desired range of the input DC voltage.

Referring now to FIG. 2*b* there is illustrated how the current is limited as of the point in time $t_1$ by the regulating action of the series regulator, this although the input voltage is still increasing. At the same time it is evident that as of the prompting point in time $t_2$ of the first threshold switch the current through the field-effect transistor 20 drops to zero.

The current flowing through the transistor 20 charges the capacitor 46 via the resistor 44. As soon as the voltage at the capacitor 46—due to an inadequate regulating action of the series regulator—exceeds the desired output voltage value, which may be dictated by suitably dimensioning the Zener diode 38 and the resistors 36 and 40, a voltage value appears at point 48 in the circuit, i.e. at the base of the transistor 42, which turns the transistor 42 ON, resulting in the gate terminal 21 of the transistor 20 being practically grounded so that this transistor 20 translates into the OFF condition. This condition is maintained as long as a voltage higher than the desired output voltage at the terminals 14, 16 is applied to the charging capacitor 46.

It is thus evident that the circuit as shown in FIG. 1 in addition to providing the regulating action by the series regulator 20, 22, 24 also regulates the charging voltage at the capacitor 46 to a constant value by the second threshold switch 36, 38, 40, 42 always becoming active and interrupting the current supplied to the capacitor 46 whenever the charging voltage at this capacitor and thus the desired regulated output DC voltage increases to exceed the design value.

The person skilled in the art will readily appreciate that each of the threshold switches acting on the gate terminal 21 of the transistor 20 is only effective when the voltage regulator circuit is fed with an AC voltage, since namely when applying a DC voltage within the defined range of the input DC voltages the current must not be totally interrupted by the transistor 20, otherwise it would no longer be possible to produce a continual output voltage between the terminals 14 and 16.

As already mentioned above the circuit is intended for the input voltage to be a DC voltage between 20V and 55V or an AC voltage between 20V and 253V, whereby the output voltage between the terminals 14 and 16 is to be maintained constant at 11V. In this case the Zener diodes 22, 32 and 38 have a Zener voltage value of 16V, 5.6V and 10V respectively.

What is claimed is:

1. A voltage regulator circuit for generating a regulated output DC voltage from a non-regulated DC or AC voltage, comprising an input rectifier circuit for rectifying said non-regulated AC voltage and a series regulator containing a gate-controllable transistor, which regulates the output voltage supplied to it by said rectifier to a first voltage value, characterized in that said transistor of said series regulator is a field-effect transistor (20) which in the ON condition charges a charging capacitor (46), the charging voltage of which forms said regulated output voltage, in that connected to a gate terminal (21) of said field-effect transistor (20) is a first threshold circuit (26, 28, 30, 32) receiving said non-regulated DC voltage which applies to said gate terminal (21) a voltage turning OFF said field-effect transistor (20) as soon as said non-regulated DC voltage exceeds a predetermined threshold value, and in that connected to said gate terminal (21) of said field-effect transistor (20) is a second threshold circuit (36, 38, 40, 22) receiving said regulated output DC voltage which applies to said gate terminal (21) a voltage turning OFF said field-effect transistor (20) as soon as said regulated output DC voltage exceeds a predetermined design value.

2. The voltage regulator circuit as set form in claim 1, characterized in that said first threshold circuit contains, between the positive output terminal of said rectifier (18) and the negative output terminal of said rectifier (18) forming ground, a voltage divider of two resistors (26, 28) connected in series, the pick-off point (34) of which is connected to said gate terminal of a field-effect transistor (30), the drain terminal of said field-effect transistor (30) being connected to said gate terminal of said field-effect transistor (20) of said series regulator while its source terminal is connected to the cathode of a Zener diode (32), the anode of which is grounded.

3. The voltage regulator circuit as set form in claim 1, characterized in that said second threshold circuit contains connected to said regulated output DC voltage a voltage divider comprising a series connection of a resistor (36), a Zener diode (38) and a further resistor (40) as well as a bipolar npn transistor (42), the base of which is connected to a connecting point (48) between said anode of said Zener diode (38) and said further resistor (40) and the collector-emitter junction of said bipolar npn transistor (42) is connected between said gate terminal of said field-effect transistor (20) of said series regulator and ground.

4. The voltage regulator circuit as set form in claim 2, characterized in that said second threshold circuit contains connected to said regulated output DC voltage a voltage divider comprising a series connection of a resistor (36), a Zener diode (38) and a further resistor (40) as well as a bipolar npn transistor (42), the base of which is connected to a connecting point (48) between said anode of said Zener diode (38) and said further resistor (40) and the collector-emitter junction of said bipolar npn transistor (42) is connected between said gate terminal of said field-effect transistor (20) of said series regulator and ground.

* * * * *